US005501048A

United States Patent [19]

Nakanishi

[11] Patent Number: 5,501,048

[45] Date of Patent: Mar. 26, 1996

[54] STRUCTURAL JOINT AND CONNECTOR

[75] Inventor: Teruo Nakanishi, Kyoto, Japan

[73] Assignee: Nakanishi Construction Company, Japan

[21] Appl. No.: 312,966

[22] Filed: Sep. 30, 1994

[51] Int. Cl.[6] ..... E02D 27/00

[52] U.S. Cl. ..... 52/296; 52/295

[58] Field of Search ..... 52/293.1, 293.3, 52/295, 296, 726.1, 730.1, 730.4, 732.1, 283, 285.2, 573.1, 294, 236.6, 236.7

[56] References Cited

U.S. PATENT DOCUMENTS 3,645,057 2/1972 Kaplan ..... 52/295

3,653,169 4/1972 Jenner ..... 52/296 X 4,750,306 6/1988 Granieri ..... 52/295 X 5,379,563 1/1995 Tinsley ..... 52/295

*Primary Examiner*—Creighton Smith

*Attorney, Agent, or Firm*—Klima & Hopkins

[57] ABSTRACT

A structural joint and connector for securely connecting a vertical post to a foundation wall. The structural joint and connector comprise a lower plate firmly connected to the foundation wall, a middle plate positioned on top of the lower plate 1, and an plate. The lateral positioning of the middle plate is adjustable to accurate position the post relative to the foundation wall.

12 Claims, 5 Drawing Sheets

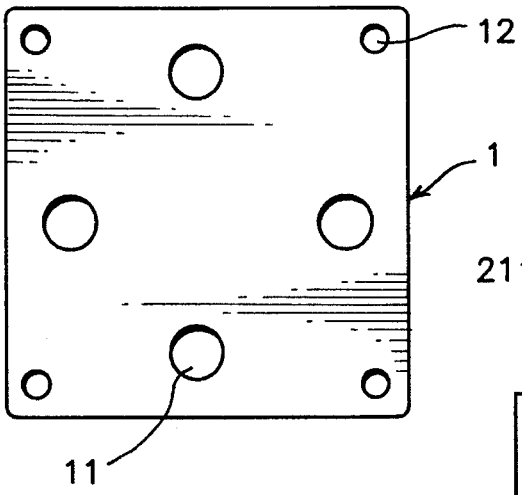
FIG. 2
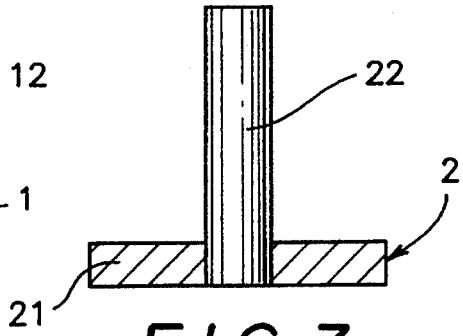
FIG. 3
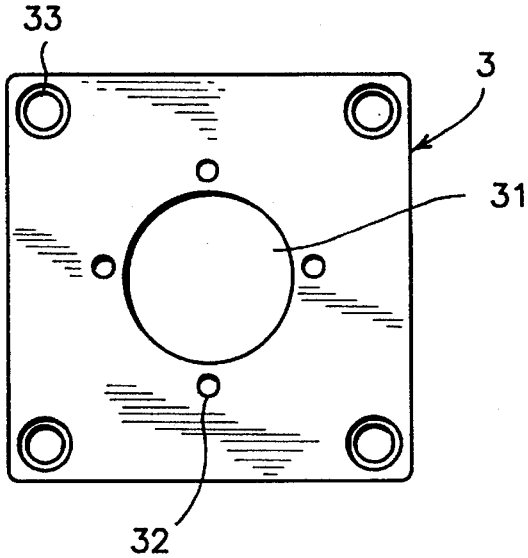
FIG. 4
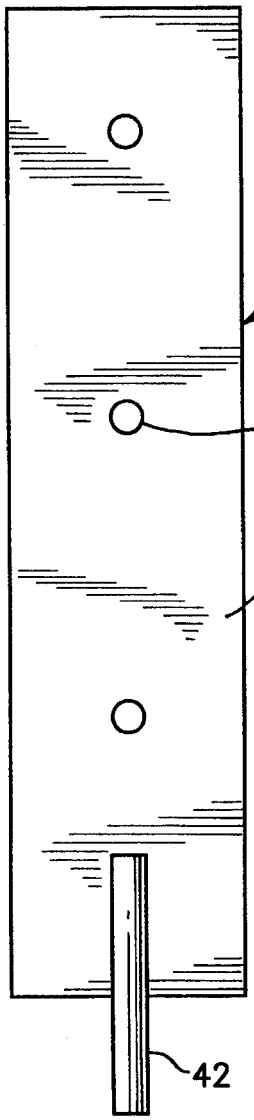
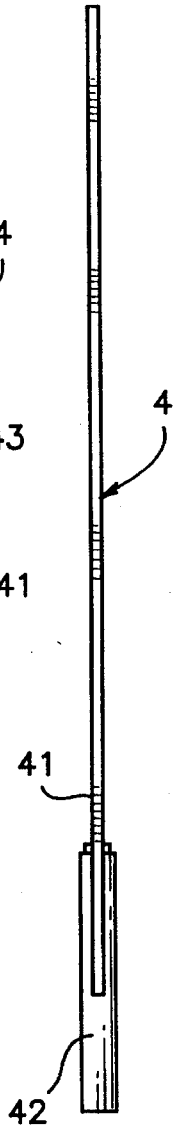
FIG. 5 FIG. 6

STRUCTURAL JOINT AND CONNECTOR

FIELD OF THE INVENTION

The present invention relates to structural joints and connectors for connecting walls to foundations, in particular to joint constructions and connectors for securely joining vertical posts to sills and foundation walls.

BACKGROUND OF THE INVENTION

In wood constructions for residential houses, a concrete foundation is poured and set, and then a wooden sill is secured (e.g. anchor bolts) to the top of the walls of the foundation. The posts are then placed on top of the wooden sill and secured by nails or other suitable fasteners. In some constructions, the wooden sills are cut to provide mortises for receiving the lower tenon ends of the posts to increase the strength of the wall construction.

In the past, residential houses where constructed with heavy tile roofing. Due to the heavy load transmitted from the roof through the posts to the foundation walls or ground sills, the posts where securely supported thereon. However, the construction of new wooden residential homes have replaced the heavy tile roofing with roofing materials which are significantly lighter. This makes the upper structure of the construction lighter reducing the strength of the joints with respect to sideways movement of the posts relative to the sills. Specifically, the posts carry less of a load reducing the shear stress between the joints between the bottom surface ends of the posts and the upper surfaces of the sills allowing the wall to be shifted laterally under a lighter side load such as applied by wind or earth quake.

For these reasons, in situation of this new type of residential construction being hit by a strong wind pressure such as generated by a typhoon, wind blast, or even by a big earthquake, it is possible that the construction can even be severely damaged or destroyed because the position of the posts on the foundation walls can be easily moved out of place or shifted, especially if the posts are directly placed on the foundation walls.

Today many three-story houses are being built to use the limited amount of land effectively. The three-story houses are typically taller than the conventional two-story houses, thus, the three-story houses are less stable than the two-story houses. In order to build three-story houses on very small building areas, the foundation must be specially constructed to withstand continuous and transient loads.

The method of construction involving connecting tenon ends of posts inserted into mortises cut into wooden sills is somewhat problematic. For example, it is difficult to fasten the posts on the centerline of the wooden sills; the designated positions to fasten the posts on the wooden sills may change slightly from the original design making it difficult to insert the tenons of the posts properly into the mortises in the wooden sills, and thus possibly requiring the mortises on the wooden sills to be reformed.

SUMMARY OF THE INVENTION

Thus, an object of the present invention is to provide an improve joint and connector for connecting a vertical post to a foundation wall in the construction of a residential home or building.

Another object of the present invention is to provide an improved joint and connector for allow lateral adjustment of the vertical post relative to the foundation wall.

A further object of the present invention is to provide an improved joint and connector for securely connecting a vertical post to a foundation wall to greatly increase the strength of the assembled wall from high side loads from wind or earth quake and prevent any inadvertent misalignment of the wall relative to the foundation wall.

The objects of the present invention can be achieved by providing a structural joint and connector including a lower plate firmly connected to the foundation wall, a middle plate with an upwardly extending threaded bolt portion positioned on top of the lower plate, an upper plate having an opening to accommodate the threaded bolt portion. In the assembled joint and connector, the upper plate is attached to the lower plate with leaving a narrow space between the lower plate and the upper plate.

A metal connector having a rectangular shaped flat plate portion is attached to a lower end of the post securely attaching the post to the foundation wall. The metal connector includes a threaded bolt portion extending downwardly from the rectangular shaped plate portion. The axis of the threaded bolt portion of the middle plate in the assembled joint and connector is aligned with Characteristics of the present invention of the foundation structure in construction, include:

1) the axis of the middle plate is aligned with the axis of the metal connector; and
2) the middle plate is adjustable laterally, and can then be securely connected in position between the upper and lower plates.

The joint structure of the present invention includes a lower plate connect on top of the foundation wall, a middle plate and an upper plate. The upper plate and the lower plate are securely fixed to the foundation wall, and the distance between the upper plate and the lower plate is slightly greater than the thickness of the middle plate. The middle plate with its upwardly extending threaded bolt portion can be moved within the area of the opening in the upper plate if the post member is not firmly fixed on the foundation wall yet. At the end of the post, a metal connector is attached and a threaded bolt portion of the metal connector protrudes from the end of the posts.

In fixing the post on the foundation wall, the middle plate is moved to adjust the position of the middle plate so that the axis of the threaded bolt portion of the metal connector is aligned with the axis of the threaded bolt portion of the middle plate. In order to stabilize the middle plate, the middle plate should be positioned from the side relative to the upper plate so that the axes are properly aligned. By connecting the threaded bolt portion of the middle plate and the threaded bolt portion of the metal connector together, the metal connector and the middle plate become one structural unit, thus the post is now firmly connected on the foundation wall.

In the event the designated position of the post is somewhat mismatched from the original design, it is possible for the position of the post to be adjusted laterally relative to the foundation wall. Thus, even if there is slight positional mismatch between the post and the foundation wall, the post can be securely fixed on the foundation wall by the lower plate, the middle plate, the upper plate and the metal connector. Moreover, because the post is attached on the foundation wall as one body, the load bearing capacity of the posts concerning upward force becomes stronger. Thus, in case the construction is hit by a strong wind pressure such as a typhoon, blast of wind, or even by a big earthquake, the post firmly secured on the foundation walls will not move out of position maintaining the integrity of the structure.

BRIEF DESCRIPTION OF THE DRAWINGS

FIG. 2 is a top planar view of the lower plate of the joint and connector shown in FIG. 1.

FIG. 3 is a cross-sectional view of the middle plate of the joint and connector shown in FIG. 1.

FIG. 4 is a top planar view of the upper plate of the joint and connector shown in FIG. 1.

FIG. 5 is a front view of the metal connector of the joint and connector shown in FIG. 1.

FIG. 6 is a side view of the metal connector of the joint and connector shown in FIG. 1.

FIG. 7(*b*) is a cross-sectional view of the threaded connector shown in FIG. 7(*a*).

DETAILED DESCRIPTION OF PREFERRED EMBODIMENTS

The present invention can be embodied in many different constructions and arrangements. The present invention will now be described by way of example.

Figure 1:
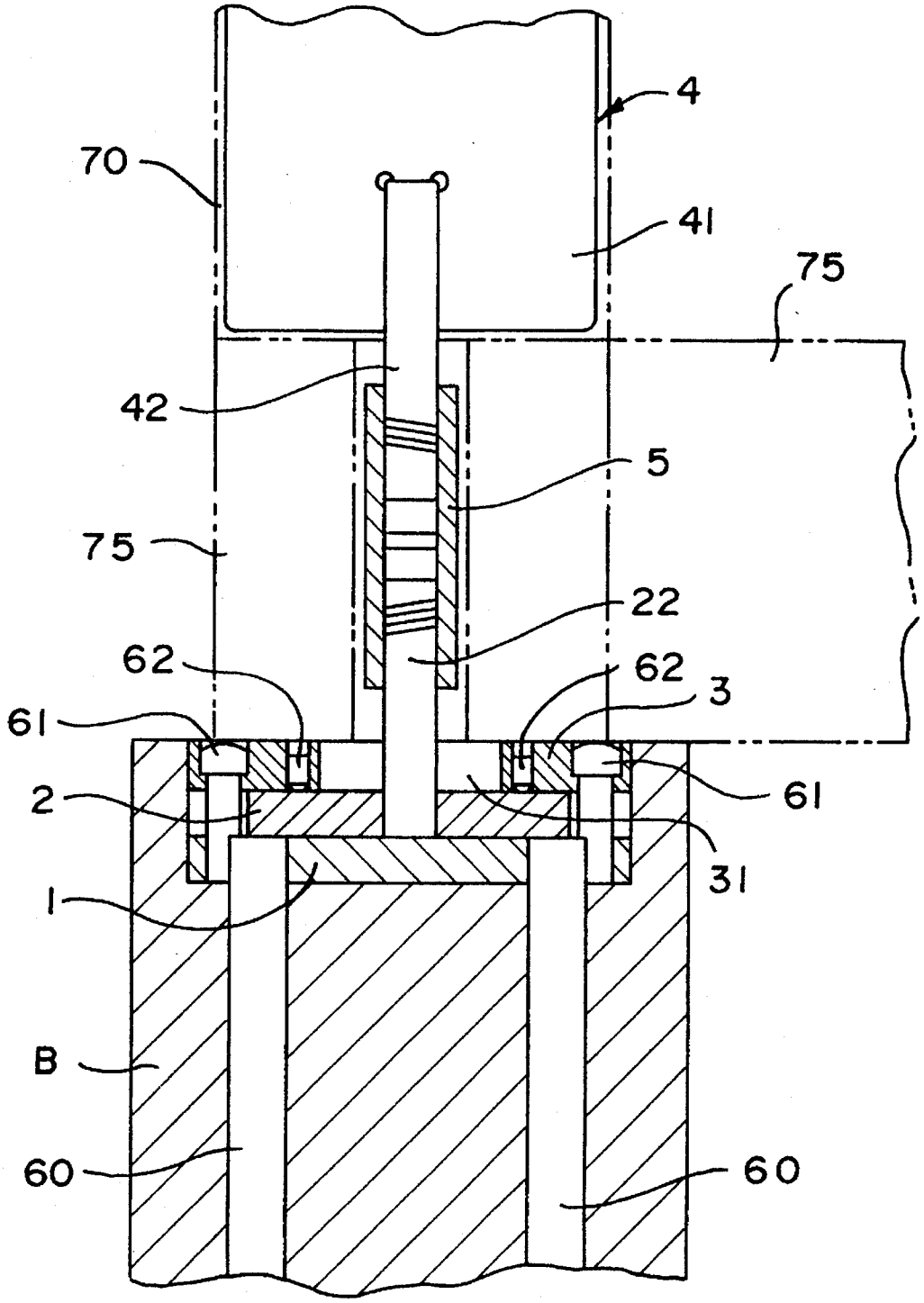
FIG. 1 is a cross-section view of a joint and connector according to the present invention.

An embodiment of the present invention is shown in FIG. 1. In this embodiment involving wood construction, the wooden post members are firmly secured on the wooden ground sill, which is fixed on top of a foundation wall. The concrete slab foundation wall B is a substructure to the wood construction. On the top of the foundation wall B is formed a square groove having a width and depth to receive a lower plate 1, a middle plate 2, and an upper plate 3.

The lower plate 1 has a square shape, as shown in FIG. 2. The lower plate 1 is provided with four threaded holes 11 located in the equal angle arrangement shown for accommodating threaded anchor bolts, and four threaded holes 12 located at corners of the lower plate 1 for accommodating threaded connecting bolts. The lower plate 1 is securely mounted in the groove provided in the top of the foundation wall B by the anchor bolts 60, as shown in FIG. 1.

The middle plate 2 is placed on top of the lower plate 1, as shown in FIG. 1. The middle plate 2 is smaller in size than the lower plate 1 and the upper plate 3, and comprises a disk plate 21 (i.e. circular shaped) and a threaded bolt portion 22. The middle plate 2 is provided with a center hole for accommodating threaded bolt portion 22, as shown in FIG. 3. The threaded bolt portion 22 extends upward vertically from the center of the disk plate 21.

Until a post 70 is firmly secured on the foundation wall B, the middle plate 2 is only placed on the lower plate 1 and not secured thereto.

As shown in FIG. 4, the upper plate 3 is square shaped like the lower plate 1. The upper plate 3 is provided with a large circular opening 31 is provided in the center of the plate 3 for receiving and accommodating free lateral movement of the threaded bolt portion 22 of the middle plate 2, and four threaded holes 32 for accommodating set screws in the plate 3 are located at equal angle distance in the arrangement shown on the periphery of the center hole 31. Further, four holes 33 are provided at the corners of the upper plate 3 for accommodating threaded securing bolts.

The upper plate 3 is firmly secured to the lower plate 1 by placing threaded connecting bolts 61 through holes 33 in the upper plate 3, and then screwing the ends of the threaded connecting bolts 61 into the threaded holes 12 of the lower plate 1. When the bolts 61 are firmly secured, the distance between the upper plate 3 and the lower plate 1 is slightly larger than the thickness of the disk plate 21 of the middle plate 2. Thus, the middle plate 2 is free to move between the lower plate 1 and the upper plate 3. The movable distance of the middle plate 2 is limited by the dimensions of the hole 31 in the upper plate 3 accommodating the threaded bolt portion 22 of the middle plate 2. Within the circular area of the hole 31, the middle plate 2 can be moved to adjust the positioning of the threaded bolt portion 22 to a desired location.

A metal connector 41 to be attached to the end of the post 70, is shown in FIG. 5 (front view) and FIG. 6 (side view). The metal connector 41 comprises a rectangular flat plate portion 41 to be inserted into an end section of the post member 70, and a threaded bolt portion 42 connected to a bottom end of the rectangular flat plate portion 41. Further, the rectangular flat plate portion 41 is provided with three holes 43 located at equal spaced intervals.

In one embodiment, the direction of the threads of the threaded bolt portion 42 of the metal connector 41 is oriented opposite (i.e. left hand thread verses right hand threaded) relative to the direction of the threads of the threaded bolt portion 22 of the middle plate 2. For example, threaded bolt portion 42 is provided with left-handed threads and the threaded bolt portion 22 is provided with right-handed threads, as shown in FIG. 1. Alternatively, the threaded bolt portions 22 and 42 have the same thread direction.

Figure 7A:
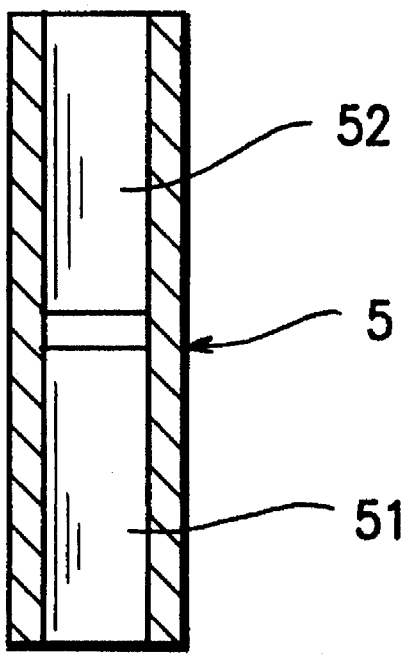
FIG. 7(*a*) is a cross-sectional view of the threaded connector of the joint and connector shown in FIG. 1.
Figure 7B:
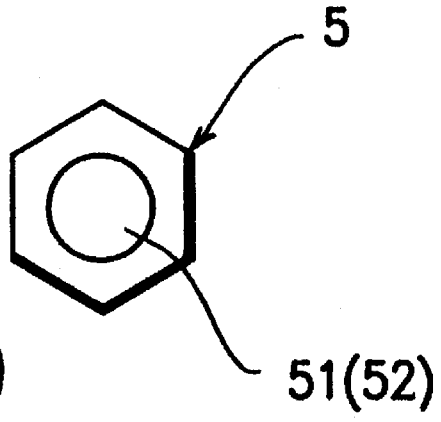

The threaded bolt portion 22 of the middle plate 2 and the threaded bolt portion 42 of the metal connector 4 are connected together by connecting nut 5, as shown in FIG. 1. The connecting nut 5 is provided with a lower half portion 51 and an upper half portion 52, as shown in FIG. 7(*a*). Further, the connecting nut 5 is provided with a hexagon outer surface and a threaded circular hole, as shown in FIG. 7*b*.

The lower half portion 51 of the connecting nut 5 is threaded onto the end of the threaded bolt portion 22 of the middle plate 2 and the upper half portion 52 of the connecting nut 5 is threaded onto the end of the threaded bolt portion 42 of the metal connector 4. Thus, both halves of the connecting nut 5 are provided with females threads for accommodating the direction of the threads of the threaded bolt portions 22 and 42. Further, the connecting nut 5 places the axis of the threaded bolt portion 22 in straight line with the axis of the threaded bolt portion 42.

Figure 10:
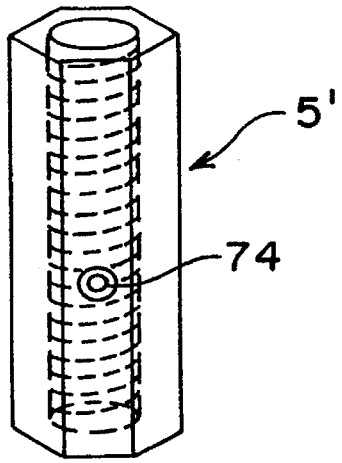
FIG. 10 is a perspective view of another preferred embodiment of the nut for connecting together the structural connector.

In FIG. 10, a preferred embodiment of the nut 5' can be provided with a set screw 74 to lock the nut 5' onto the threaded bolt portion 22 to prevent it from rotating during assembly of the structural connector. Alternatively, the threaded bolt portion 22 is provided with a limited length of threads so that when the nut 5 (without a set screw) is threaded on to a limited extent, the threads of the nut 5 lock with the unthreaded portion of the threaded bolt portion 22.

The post 70 is firmly secured on top of sill plate 75 located on top of the foundation wall B by the metal connector 4, lower plate 1, middle plate 2 and upper plate 3 assembled together. Further, this assembly allows the post 70 to be secured on the center line of the sill plate 75.

Figure 8:
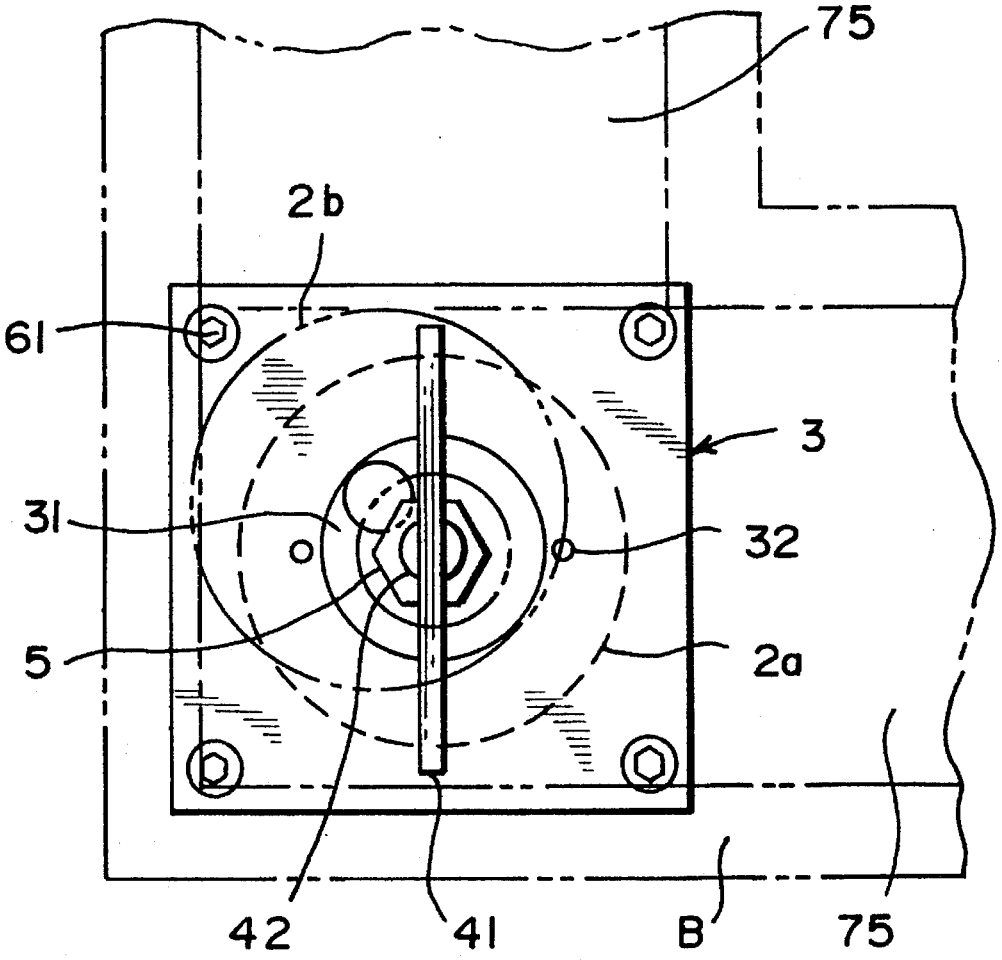
FIG. 8 is a top planar view of joint and connector shown in FIG. 1, illustrating the axis of the middle plate and the axis of the metal connector are aligned.

The assembled is joint is shown in FIG. 8 with the threaded bolt portion 42 connected to the threaded bolt portion 22 being located somewhat off center with respect to the hole 31 in the upper plate 3. In contrast, the condition where the threaded bolt portion 42 and the threaded bolt portion are centered with respect to the hole 31 is shown with the dotted line. It is possible to adjust and accurately secure the middle plate 2 by screwing the set screws 62 into the threaded holes 32 even if the position of the axes of the threaded bolt portion 42 and the threaded bolt portion 22 are off center near the circumference of the hold 31 in the upper plate 3.

Figure 9:
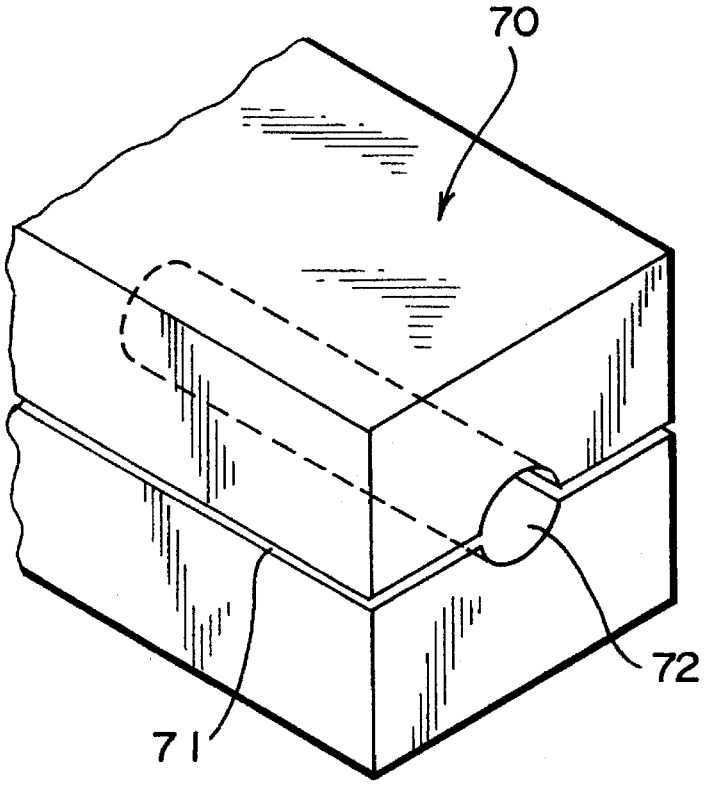
FIG. 9 is a perspective view of the bottom end of a post provided with a slot and hole for accommodating the metal connector.

As shown in FIG. 9, the post 70 is provided with a notch 71 to accommodate the flat rectangular plate 41 of the metal connector 4, a cylinder shaped hole 72 to accommodate the threaded bolt portion 42 of the metal portion 4, and three holes (not shown) corresponding to the holes 42 in the rectangular flat plate 41. The metal connector 4 with the rectangular flat plate 41 inserted in the notch 71 and the threaded bolt portion 42 inserted in the hole 72, is firmly secured in the end portion of the post 70 by inserting securing bolts through the three holes 43 and corresponding holes in the post 70. In this arrangement, the end of the threaded bolt portion 42 of the metal connector 4 protrudes from the end portion of the post 70.

The sill plate 75 is provided with a hole for accommodating the connecting nut 5, as shown in FIG. 1. The hole is made large enough to allow the axis of the threaded bolt portions 22 and 24 to be moved and adjusted.

ASSEMBLY OF CONNECTOR

To secure the post 70 on the foundation wall B, the middle plate 2 is moved so that the axis of the threaded bolt portion 22 of the middle plate 2 and the axis of the threaded bolt portion 42 of the metal connector 4 meet on a straight line. At the same time, the position of the axis of the threaded bolt portion 22 is adjusted in order to place the post 70 accurately on the center line of the sill plate 75. After the adjustment, the set screws 62 are tightened in the four threaded holes 32 in the upper plate 3. Thus, the middle plate 2 is firmly secured by the ends of the set screws 62 placed in contact with the upper surfaced of the disc portion 21 of the middle plate 2.

The present invention is not limited to the above example. It is only an example and many changes and modifications can be made, and still be within the scope of the present invention. For example, the above example has been described concerning wooden constructions, however, the same method can be used for steel frame constructions. In such applications, the post and the ground sill are steel members, but just like the in above example, the posts are firmly secured on the sills of the foundation walls.

As explained above, the present invention is characterized by:

1) a structural connector comprising a lower, middle and upper plates connected on top of the foundation wall, which is the substructure of the construction;

2) a metal connector of the structural connector is attached to the lower end of the post member of the superstructure;

3) the middle plate of the structural connector is secured after adjusting the position of axis of the metal connector and the axis of the middle plate; and 4) both threaded bolt portions of the metal connector and middle plate are connected together with a threaded bolt along the same axis.

Thus, the post member is firmly secured at the proper place on the foundation wall.

Even if the designated position to stabilize the post on the foundation wall is somewhat misaligned from the original design, since it is possible to move the middle plate to align the axis of the middle plate to the axis of the metal connector, the post members can be firmly secured on the foundation wall after easily adjusting the positional misalignment of the post members with respect to the side of the foundation wall. Moreover, unlike the former methods of either wood posts directly placed on the foundation wall or tenoned and mortised on the ground sills, because the post is attached on the foundation wall as one body, this construction can withstand consistent high wind pressures such as from a typhoon, transient wind blasts, or even survive a large earthquake, due to the posts being firmly secured on the foundation walls never allowing the posts to be moved out of position. Thus, the structural stability of the super structure is greatly improved.

ASSEMBLY OF THE JOINT

The assembly of the joint begins by constructing a form, and pouring the foundation wall B. A groove running in the direction of the wall B is provided in the top thereof, as shown in FIG. 1 by various know methods.

Further, the anchor bolts 60 are positioning desirably either prior to pouring the foundation wall B, or after the foundation wall B has been poured during setting of the concrete.

The lower plate 1 is then bolt down to the top of the foundation wall by four (4) anchor bolts 60. The middle plate 2 is then placed on top of the lower plate 1, and then the top plate 3 is positioned on top of the middle plate 2. Specifically, the top plate 3 is lowered vertically downward so that the threaded bolt portion 22 of the middle plate 2 passes through the opening 31 in the top plate 3. Then, the top plate 3 is bolted to the bottom plate 1 by the four threaded connecting bolts 61 providing a space between the upper plate 3 and lower plate 1 sufficient to allow the middle plate 2 to be freely moved in a traverse direction relative to the wall.

The position of the middle plate 2 is then adjusted so that the sill plate 75 will be properly set on top of the foundation wall B. For example, the middle plate 2 may be adjusted so that the threaded bolt portion 22 of the middle plated is positioned on center of the width of the foundation wall B. Thus, the sill plate 75 can then be easily positioned on center along the length of the foundation wall B. In another applications, the foundation wall B may have been poured somewhat off specification, or minor changes to the design of the foundation wall B may have occurred during construction. In such situations the position of the middle plate 2 can be adjusted to compensate for such situations.

When the position of the middle plate is finally adjusted, the four set screws 62 are tightened to lock the middle plate from movement and stabilize the structural connector. Further, the nut 5 is threaded onto the threaded bolt portion 22 and secured from relative movement therewith. For example, the nut 5' can be provided with a set screw 74, as shown in FIG. 10, to lock the nut 5' onto the threaded bolt portion 22 to prevent it from rotating. Alternatively, the threaded bolt portion 22 is provided with a limited length of threads so that when the nut 5 is threaded on to a limited extent, the threads of the nut lock with the unthreaded portion of the threaded bolt portion 22.

The sill plate 75 is drilled prior to installation at the proper position to accommodated the threaded bolt portions 22 and 42, and nut 5. The sill plate 75 is then laid down and its position adjusted on top of the foundation wall B.

The threaded bolt portion 42 of the metal connector 4 is then threaded into the nut 5, preferably until the lower edge of the rectangular plate portion 41 bottoms or comes into contact with the top of the sill plate 75. The metal connector 4 may be further rotated so that the lower edge thereof begins to bury itself into the upper surface of the wooden sill plate, and rotated a final increment so as to be properly aligned (i.e. traverse direction of sill plate).

The lower end of the post 70 is cut or machined to provide the notch 71 and hole 72, as shown in FIG. 9. The lower end of the post 70 is then vertically lowered down onto the metal connector 4 until the bottom surface of the post is place in full load bearing contact with the sill plate 75. Three bolt or screw fasteners are then secured through the side of the bottom of the post 70 and the three holes in the rectangular plate portion 41 of the metal connector 4 to securely fasten these components together.

A plurality of posts 70 are structurally connected to the foundation wall in the same manner, and then additional siding, wall board, bracing an other materials are attached to the posts to form the completed superstructure wall.

What is claimed is:

1. A structural joint connector for connecting a post to a foundation wall, said structural joint connector comprising:

a lower plate to be connected to the foundation wall;

a middle plate positioned above said lower plate, said middle plate including a plate portion and a threaded bolt portion extending upwardly from said plate portion;

an upper plate with a center opening for receiving and accommodating free lateral movement of said threaded bolt portion of said middle plate, said upper plate is connected to said lower plate when the structural joint is assembled providing a space that is sufficient to receive and accommodate free lateral movement of said middle plate between said upper plate and said lower plate;

a metal connector to be connected to the lower end of the post, said metal connector including a flat plate portion and a threaded bolt portion extending downwardly from said flat plate portion; and a threaded connector for connecting said threaded bolt portion of said middle plate with said threaded bolt portion of said metal connector.

2. The connector according to claim 1, wherein said plate portion of said middle plate is a disk plate.

3. The connector according to claim 1, wherein said flat plate portion of said metal connector is a rectangular shaped flat plate portion.

4. The connector according to claim 3, wherein said rectangular shaped flat plate portion is provided with one or more through holes for accommodating a fastener for connecting said rectangular shaped flat plate portion to the post.

5. The connector according to claim 1, including one or more anchor bolts for connecting said lower plate to the foundation wall, said anchor bolt being embedded in the concrete wall and extending through a hole in said lower plate.

6. The connector according to claim 1, wherein said upper plate is provided with at least one hole, and said lower plate is provided with at least one threaded hole, and including at least one thread bolt passed through the hole in said upper plate and threaded into said threaded hole in said lower plate for connecting said upper and lower plates together.

7. The connector according to claim 1, wherein said upper plate includes at least one threaded hole, and including at least one set screw threaded into said threaded hole in said upper plate for securing said middle plate from movement once the joint is adjusted.

8. The connector according to claim 1, wherein said threaded connector is a hexagon nut having a set screw.

9. A structural joint, comprising:

a foundation wall having a longitudinal groove in the top thereof;

a sill plate connected on top of said foundation wall;

a vertical post positioned on top of said sill plate; and a structural connector, said structural connector, including:

a lower plate connected to said foundation wall;

a middle plate positioned above said lower plate, said middle plate including a plate portion and a threaded bolt portion extending upwardly from said plate portion;

an upper plate with a center opening for receiving and accommodating free lateral movement of said threaded bolt portion of said middle plate, said upper plate is connected to said lower plate when the structural joint is assembled providing a space that is sufficient to receive and accommodate free lateral movement of said middle plate between said upper plate and said lower plate;

a metal connector connected to a lower end of said post, said metal connector including a flat plate portion and a threaded bolt portion extending downwardly from said flat plate portion; and a threaded connector for connecting said threaded bolt portion of said middle plate with said threaded bolt portion of said metal connector.

10. The joint according to claim 9, wherein said sill plate is provided with a hold for accommodating said threaded bolt portion of said metal connector, said threaded bolt portion of said middle plate, and said threaded connector, said hole is said sill plate having a sufficient diameter to accommodate lateral movement of said threaded connector for adjustment of said post relative to said sill plate.

11. A joint according to claim 9, including one or more anchor bolts embedded in said foundation wall and extending from the top of the foundation wall, said one or more anchor bolts connecting said lower plated to the foundation wall.

12. A joint according to claim 9, wherein said flat plate portion of said metal connector is a rectangular shaped flat plate portion, and said lower end of said post is provided with both a slit to accommodate said rectangular shaped flat plate portion and a hole to accommodate said threaded bolt portion of said metal connector.

* * * * *

UNITED STATES PATENT AND TRADEMARK OFFICE

CERTIFICATE OF CORRECTION

PATENT NO. : 5,501,048
DATED : March 26, 1996
INVENTOR(S) : Teruo NAKANISHI

It is certified that error appears in the above-indentified patent and that said Letters Patent is hereby corrected as shown below:

On the title page, please insert the missing Foreign Application Priority Data:

--September 30, 1993 [JP] Japan .....5-245127--

Signed and Sealed this

FourthDay of August, 1998

Bruce Lehman

*Attest:*

BRUCE LEHMAN

*Attesting Officer*

*Commissioner of Patents and Trademarks*